US009187160B2

(12) United States Patent
McJunkin

(10) Patent No.: US 9,187,160 B2
(45) Date of Patent: Nov. 17, 2015

(54) SURFACE FLOATING APPARATUS FOR DIVING

(71) Applicant: Matthew Mark McJunkin, Marathon, FL (US)

(72) Inventor: Matthew Mark McJunkin, Marathon, FL (US)

( * ) Notice: Subject to any disclaimer, the term of this patent is extended or adjusted under 35 U.S.C. 154(b) by 0 days.

(21) Appl. No.: 14/532,197

(22) Filed: Nov. 4, 2014

(65) Prior Publication Data

US 2015/0125219 A1 May 7, 2015

Related U.S. Application Data

(60) Provisional application No. 61/900,178, filed on Nov. 5, 2013.

(51) Int. Cl.

| | |
|---|---|
| ***B63C 11/20*** | (2006.01) |
| ***B63C 11/18*** | (2006.01) |
| *B63C 11/02* | (2006.01) |
| *B63C 11/26* | (2006.01) |

(52) U.S. Cl.
CPC ..... *B63C 11/18* (2013.01); *B63C 11/26* (2013.01); *B63C 2011/026* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,754,996 | A * | 7/1988 | Tecca | F17C 13/084 294/151 |
| 4,919,631 | A | 4/1990 | Stafford | |
| 4,986,267 | A | 1/1991 | Doss | |
| 5,622,165 | A | 4/1997 | Huang | |
| 5,893,362 | A | 4/1999 | Evans | |
| 7,353,767 | B2 | 4/2008 | Taelman | |
| 7,722,419 | B1 | 5/2010 | Wood | |
| 7,909,540 | B2 | 3/2011 | Leishman | |
| 2011/0116029 | A1 | 5/2011 | Funahashi | |
| 2015/0024645 | A1 * | 1/2015 | Neal | A63B 31/00 441/88 |
| 2015/0093201 | A1 * | 4/2015 | Escano Cavanilles | B63C 11/202 405/94 |

* cited by examiner

*Primary Examiner* — Benjamin Fiorello
*Assistant Examiner* — Kyle Armstrong
(74) *Attorney, Agent, or Firm* — IDP Patent Services; Olav M. Underdal

(57) ABSTRACT

A flotation device for diving, includes a u-shaped holster; a flotation piece, positioned inside the holster; and a connection harness, such that the connection harness can hold a tank with compressed breathing gas for diving, and a diver breathes underwater via a hose attached to the tank. The flotation device can further include adjustable straps, a carrying strap with a handle. The holster can further include an insertion aperture and at least one reinforcement strap. The flotation device can be a cylindrical elongated piece, including a pool noodle, and can be made from polyethylene foam. Also included is a flotation device for diving, including a u-shaped holster and a connection harness, such that a flotation piece can be positioned inside the holster.

18 Claims, 4 Drawing Sheets

Flotation Device

Flotation Piece

SURFACE FLOATING APPARATUS FOR DIVING

CROSS-REFERENCE TO RELATED APPLICATIONS

This application claims the benefit of U.S. Provisional Application No. 61/900,178, filed Nov. 5, 2013, which is included herein by reference in its entirety.

FIELD OF THE INVENTION

The present invention relates generally to the field of diving, and more particularly to methods, systems, and devices for providing flotation of a breathing apparatus or other diving related equipment.

BACKGROUND OF THE INVENTION

Underwater diving has become increasingly popular as a recreational activity. However, widespread adoption of recreational diving is constrained by time-consuming licensing requirement, and use of heavy and expensive scuba diving equipment.

As an alternative to conventional underwater diving, modern devices for surface-supplied diving have emerged in the past decades. These devices allow a scuba diving like experience, with only limited training and less complicated equipment.

However, such devices that are used for floating breathing apparatuses or tanks are typically large and expensive, rely on air-inflated flotation, and can be cumbersome in use. Due to their large size, they are not easily carried to or from remote locations, and are generally impossible to transport in personal carry-on luggage.

As such, considering the foregoing, it may be appreciated that there continues to be a need for novel and improved devices and methods for surface-supplied diving.

SUMMARY OF THE INVENTION

The foregoing needs are met, to a great extent, by the present invention, wherein in aspects of this invention, enhancements are provided to the existing models for surface-supplied diving equipment.

In an aspect, a flotation device for diving, can include:

a) a u-shaped holster;

b) a flotation piece, which is inside the holster, such that the flotation piece adapts to the shape of the holster;

c) a connection harness, which is attached to the holster;

such that the connection harness holds a tank with compressed breathing gas for diving, and the flotation device provides buoyancy to float the flotation device, such that a diver breathes via a hose attached to the tank.

In a related aspect, the connection harness can further include at least two adjustable straps, such that each strap is tightened around the tank.

In a related aspect, the flotation device can be an elongated cylindrical piece made from closed-cell polyethylene foam.

In a further related aspect, the flotation device can be a pool noodle.

In another aspect, a flotation device for diving can include:

a) a holster, which is substantially u-shaped;

b) a connection harness, which is attached to the holster;

such that the connection harness holds a tank with compressed breathing gas for diving, whereby the flotation device for diving, with the attached tank remains floating due to buoyancy provided by a flotation piece that is inserted into the holster, such that a diver breathes via a hose attached to the tank There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

Figure 1:
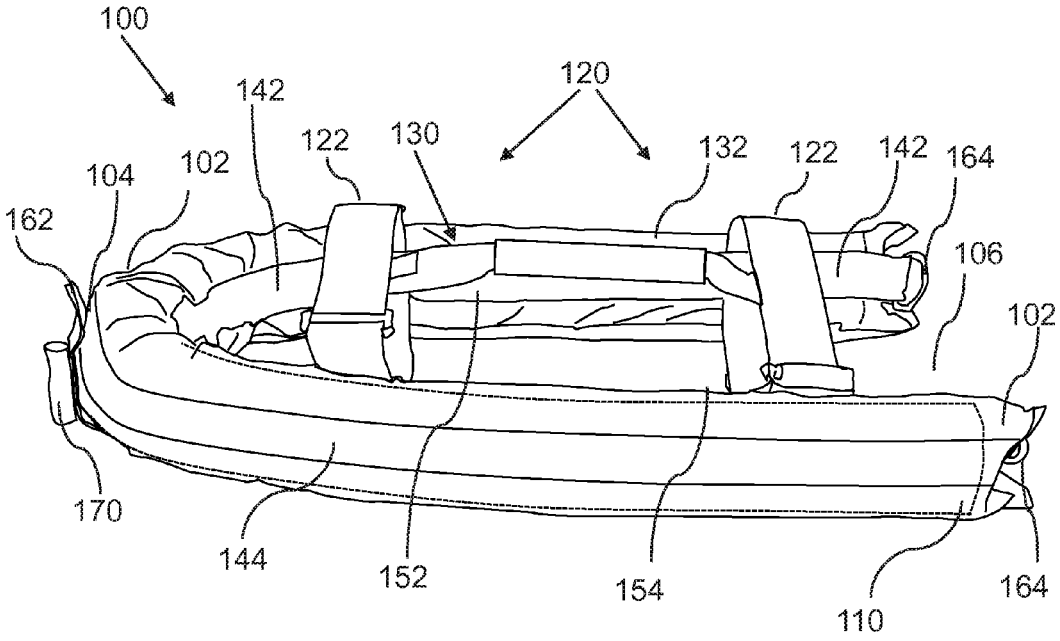
FIG. 1 is a perspective view of a flotation device for diving, according to an embodiment of the invention.

In the following, we describe the structure of an embodiment of a flotation device for diving 100 with reference to FIG. 1, in such manner that like reference numerals refer to like components throughout; a convention that we shall employ for the remainder of this specification.

In an embodiment a flotation device for diving 100 can comprise:

a) A holster 102, which is substantially u-shaped, such that the holster 102 is closed in a front 104 and open in a rear 106, and contains a cavity;

b) A flotation piece 110, which is inside the holster 102, in the cavity of the holster 102, such that the flotation piece 110 adapts to the shape of the holster 102;

c) A connection harness 120, which is attached to the holster 102; such that the connection harness for example can comprise two or more adjustable straps 122, such that each adjustable strap 122 is attached to both a right inner side 152 and a left inner side 154 of the holster 102;

whereby the adjustable straps 122 can be tightened around a tank with compressed breathing gas for diving, and whereby the flotation device for diving 100, with the attached tank can remain floating due to buoyancy provided by the flotation piece 110, such that a diver breathes via a hose attached to the tank.

In related embodiments, the flotation device for diving 100 can allow a diver to dive to a depth of at least up to 50 feet.

In a related embodiment, the flotation device for diving 100 can further include a carrying strap 130, which is connected to the connection harness 120. The carrying strap 130 can further be mounted between the adjustable straps 122, such that the carrying strap 130 can be connected in each end of the carrying strap 130, to an adjustable strap 122.

In a related embodiment, the carrying strap 130 can further include a handle 132. As shown in FIG. 1, the handle 132 can be configured as a cylindrical tube, which for example can be made of a PVC plastic material, such that the carrying strap passes through the handle.

In a related embodiment, the holster 102 can be an elongated cylindrical structure.

In a related embodiment, the flotation piece 110 can be an elongated cylindrical structure, with dimensions such that it fits inside the holster 102.

In a further related embodiment, the flotation piece 110 can be a pool noodle, in the form of an elongated cylindrical piece of foam.

In a further related embodiment, the flotation piece 110 in a pool noodle configuration can be:

a. Hollow, with a center-positioned elongated cavity throughout the length of the pool noodle flotation piece 110; or b. Solid-core, with a solid foam configuration throughout the length of the pool noodle flotation piece 110.

In another further related embodiment, the flotation piece 110 in a pool noodle configuration can have a diameter in a range of 2 to 7 inches, for embodiments suitable to float a breathing tank of different sizes and weights.

In another further related embodiment, the flotation piece 110 in a pool noodle configuration can be made of closed cell polyethylene foam. In a further related embodiment, the closed cell polyethylene foam can have a density of 1.5-3.0 lb. per cubic foot.

In yet a further related embodiment, the flotation piece 110 can be an off-the-shelf pool noodle, for example purchased by a consumer in a retail store, with a particular matching diameter, and cut to an appropriate length by the consumer, or having a suitable off-the-shelf length.

In an embodiment, an inner side reinforcement strap 142 can be connected to an inner side of a surface of the holster 102. The inner side reinforcement strap 142 can for example be made of a nylon webbing strap material.

In a related embodiment, an outer side reinforcement strap 144 can be connected to an outer side of the surface of the holster 102. The outer side reinforcement strap 144 can for example be made of a nylon webbing strap material.

In a related embodiment, a flotation device for diving 100 can be configured as small horseshoe shape surface floating apparatus intended for flotation of a self-contained breathing apparatus, such that a diver can dive beneath the flotation device for diving 100, breathing gas from a hose connection to the breathing apparatus.

In a related embodiment, a flotation device for diving 100, which can also be referred to as a Hookahroo™, can be folded to be stored in a space the size of a handbag, when stored without the flotation piece 110. The flotation device for diving 100 is easily put together from a stored configuration, and does not need to be inflated and is lightweight.

In a related embodiment, the flotation device for diving 100 can be manufactured in a lightweight configuration, which is convenient for travel, and can easily be hand-carried to a diving location.

In various embodiments, advantages of the flotation device for diving 100 include that the device:

a. Is low cost to manufacture;

b. Is compact, both in use and when folded for storage or transportation;

c. Is easy to prepare for use;

d. Is reliable in use;

e. Cannot puncture or leak;

f. Is easy to carry to a diving location.

In various related embodiments, the flotation device for diving 100 can be attached to the back of a boat as a flotation device for boaters who need extra assistance in the water. The device can also be used for flotation while snorkeling, and in addition, boaters can use the device to clean the bottoms of their boat with ease.

In related embodiments, the flotation device for diving 100 can be configured to carry additional equipment, such as hoses, additional tanks, compressors, weight belts, and/or harness systems.

In related embodiments, components of the flotation device for diving 100 can be sewn together using a UV resistant polyester thread. The thread can for example have a weight of 8 oz. per 2250 yards.

In a related embodiment, the connection harness 120 can be made from a webbing strap material. The webbing strap material can for example be made from nylon. The webbing strap can be reinforced with a binding, such as for example a Sunbrella centerfold Binding™, with a total width of 1 inch before application.

In a related embodiment, the holster 102 can be made from a heavy-duty mesh fabric, whereby the mesh fabric can allow for easy drainage of water. The mesh fabric can for example be a UV resistant nylon mesh or a polyester mesh.

In a further related example embodiment, the mesh fabric can be a 100% vinyl-coated woven polyester mesh, of the brand Phifertex™, with a shade factor of 70%.

In an alternative embodiment, the holster 102 can be made from a sailcloth material, such as a Kevlar laminate sailcloth. In related embodiments, the holster 102 can have at least one hole for drainage of water.

In a related embodiment, the holster 102 can further include a front-mounted d-ring 162.

In a further related embodiment, the front mounted d-ring 162 can have an attached hook or loop, which can be made with a nylon webbing material.

In a further related embodiment, a front of the holster 102 can have an attached flagpole holder 170, which can be an elongated hollow cylinder with an opening in an upper end. The cylinder can for example be a plastic cylinder, or be formed as a cavity between two webbing straps that are stitched together, or a folded webbing strap that is stitched on one elongated side, and stitched closed in a bottom end, thereby forming a cavity into which the flagpole can be inserted.

In another related embodiment, the holster 102 can further include at least one rear-mounted d-ring 164. The rear-mounted d-ring can further have an attached hook or loop, which can be made with a nylon webbing material.

The d-rings 162 164 can for example be made from a plastic material, or from a saltwater rated metal, metal alloy, or anodized metal.

The loop can further include a hook and loop fastener, such that the loop can be opened and closed, to secure an item, such as a diving flag.

Figure 2:
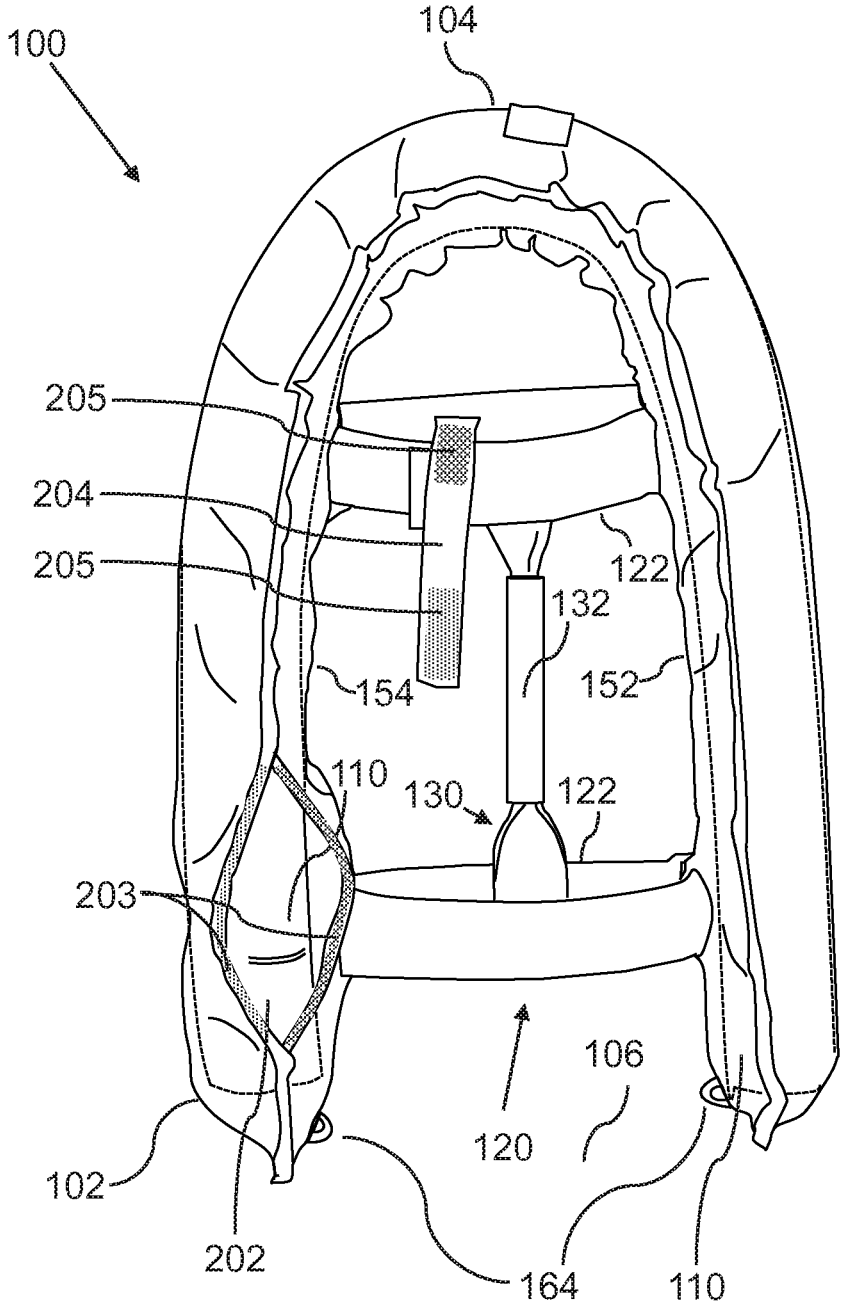
FIG. 2 is a bottom view of a flotation device for diving, according to an embodiment of the invention.

FIG. 2. Illustrates a bottom view of an embodiment of the flotation device for diving 100, further including a hose strap 204 for attaching a hose connected to a tank carried by the flotation device for diving 100, such that the hose strap is connected to a bottom outside surface of the connection harness 120. The house strap can alleviate strain on a connection of the hose to the tank, and ensure that a pulling force from the hose is centered underneath the flotation device for diving 100, rather than in the front, to avoid the front being pulled under water. The hose strap 204 can further include a hook and loop fastener 205, and can be connected.

In a related embodiment, illustrated in FIG. 2, the holster 102 can further include an insertion aperture 202 for inserting the flotation piece 110 into the inside cavity of the holster 102. The insertion aperture 202 can further include an aperture closing mechanism 203 to allow easy opening and closing of the insertion aperture 202. As shown, the aperture closing mechanism can be a hook and loop fastener, or it can be snap-lock buttons, a zipper, or another conventional mechanism for allowing convenient closing and opening of a pocket or other aperture.

Figure 3:
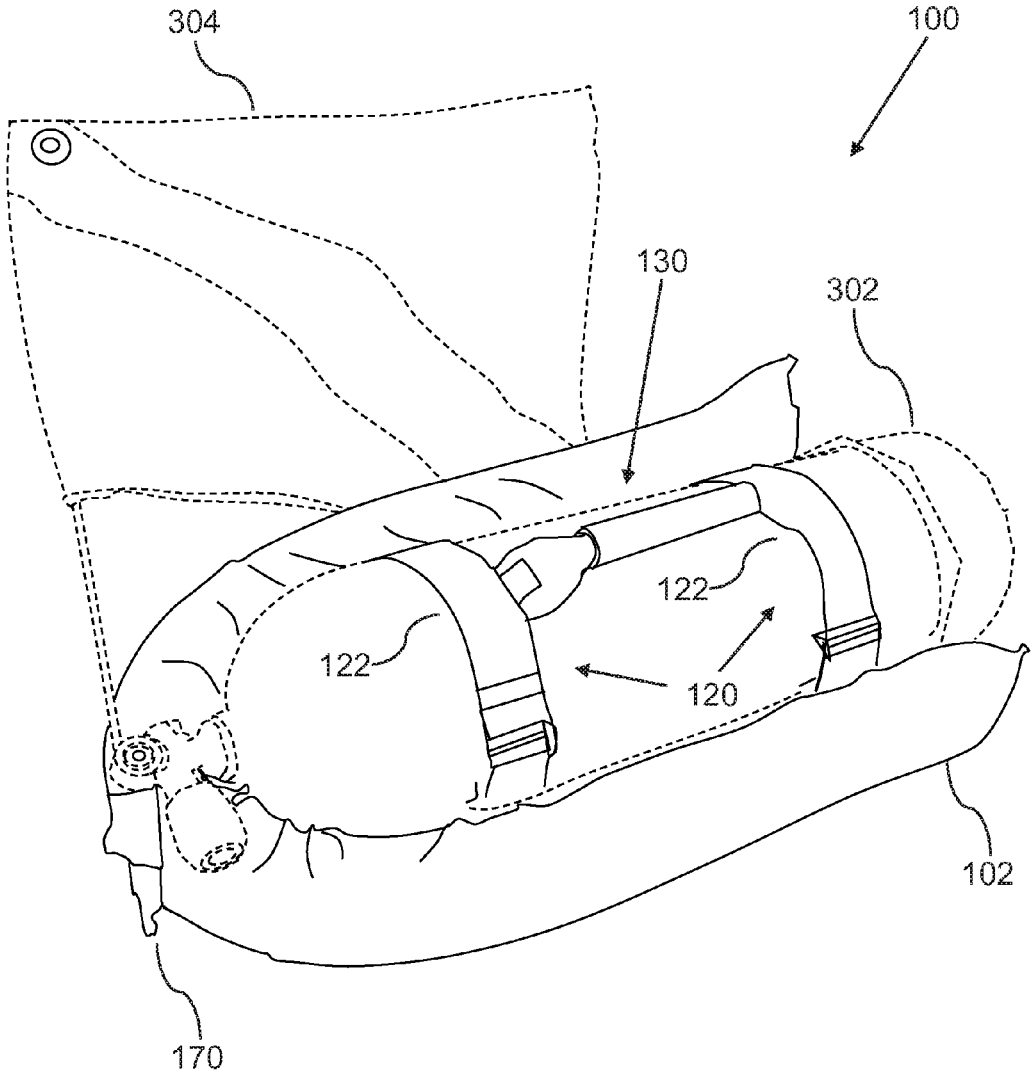
FIG. 3 is a perspective view of a flotation device for diving, according to an embodiment of the invention.

FIG. 3 illustrates a perspective view of a related embodiment, wherein a tank 302 with compressed breathing gas for diving is mounted in the flotation device for diving 100, and a diving flag 304, including a flagpole, which has been attached to a front-mounted flagpole holder 170.

Figure 4:
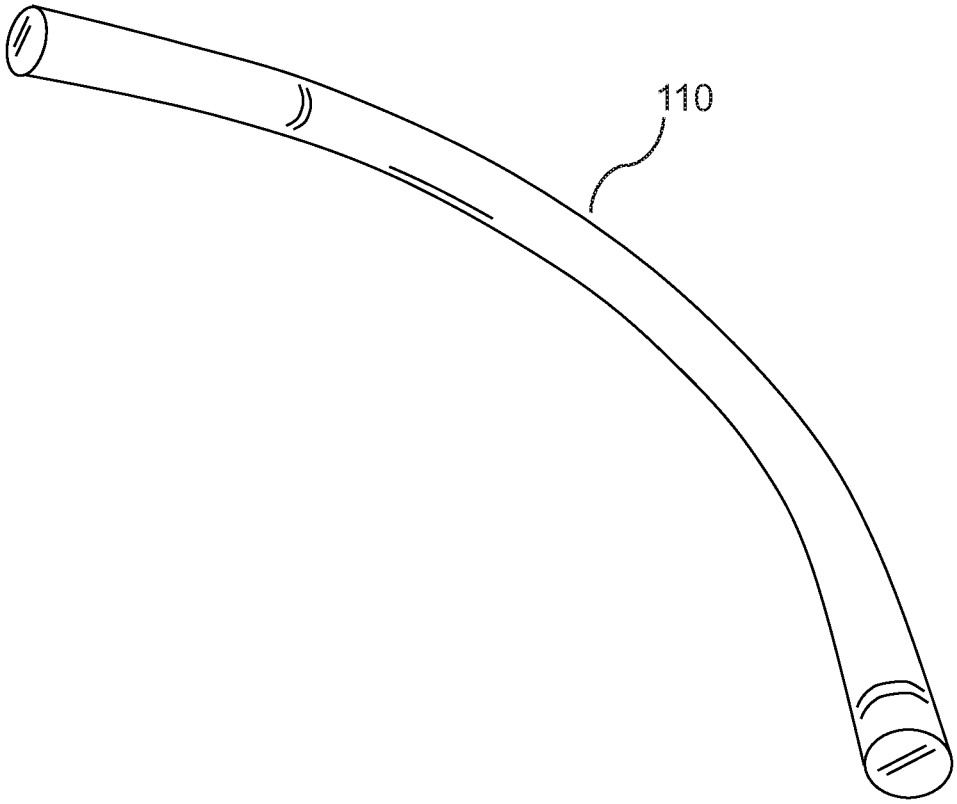
FIG. 4 is a perspective view of a flotation piece, according to an embodiment of the invention.

In a related embodiment, FIG. 4 illustrates a perspective view of a flotation piece 110, in the form of a flexible solid-core pool noodle. The flotation piece 110 is shown slightly curved, prior to insertion into the holster 102.

In an alternative embodiment, a flotation device for diving can comprise solely of a substantially u-shaped non-inflatable flotation piece, to which the connection harness is attached directly, without the need for a separate holster 102.

The many features and advantages of the invention are apparent from the detailed specification, and thus, it is intended by the appended claims to cover all such features and advantages of the invention, which fall within the true spirit and scope of the invention.

Many such alternative configurations are readily apparent, and should be considered fully included in this specification and the claims appended hereto. Accordingly, since numerous modifications and variations will readily occur to those skilled in the art, it is not desired to limit the invention to the exact construction and operation illustrated and described, and thus, all suitable modifications and equivalents may be resorted to, falling within the scope of the invention.

What is claimed is:

1. A flotation device for diving, comprising:

a) a holster, which is substantially u-shaped and further comprises a cavity;

b) a flotation piece, which is inside the holster, in the cavity of the holster, such that the flotation piece adapts to a shape of the holster;

c) a connection harness, which is attached to the holster, and further comprises at least two adjustable straps;

d) a carrying strap, which is attached to the at least two adjustable straps at the top of the floatation device;

wherein the connection harness holds a tank with compressed breathing gas for diving, and wherein the flotation device, with the tank attached, remains floating due to buoyancy provided by the flotation piece, such that a diver breathes via a hose attached to the tank.

2. The flotation device of claim 1, wherein the at least two adjustable straps are attached to both a right inner side and a left inner side of the holster, such that each strap is tightened around the tank.

3. The flotation device of claim 1, further comprising a handle, such that the handle is configured as a cylindrical tube, such that the carrying strap passes through the handle.

4. The flotation device of claim 1, wherein the holster is an elongated cylindrical member.

5. The flotation device of claim 1, wherein the flotation piece is an elongated cylindrical piece.

6. The flotation device of claim 5, wherein the flotation piece is made from closed cell polyethylene foam, wherein the flotation piece is hollow, such that the flotation piece further comprises a center-positioned elongated cavity throughout the length of the flotation piece.

7. The flotation device of claim 5, wherein the flotation piece is made from closed cell polyethylene foam, wherein the flotation piece is solid-core, such that the flotation piece is in a solid configuration.

8. The flotation device of claim 5, wherein the flotation piece has a diameter in a range of 2-7 inches.

9. The flotation device of claim 5, wherein the holster further comprises at least one reinforcement strap.

10. The flotation device of claim 1, wherein the flotation piece is made from closed cell polyethylene foam.

11. The flotation device of claim 1, wherein the holster is made from a polyethylene mesh fabric.

12. The flotation device of claim 1, wherein the holster further comprises an insertion aperture for inserting the flotation piece into the cavity of the holster.

13. The flotation device of claim 12, wherein the insertion aperture further comprises a hook and loop fastener, which functions as an aperture closing mechanism.

14. A flotation device for diving, comprising:

a) a holster, which is substantially u-shaped and further comprises a cavity;

b) a connection harness, which is attached to the holster, and further comprises at least two adjustable straps;

c) a carrying strap, which is attached to the at least two adjustable straps at the top of the floatation device;

wherein the connection harness holds a tank with compressed breathing gas for diving;

whereby the flotation device, with the tank attached, remains floating due to buoyancy provided by a flotation piece that is inserted into the holster, such that the flotation piece adapts to a shape of the holster, such that a diver breathes via a hose attached to the tank.

15. The flotation device of claim 14, wherein the at least two adjustable straps are attached to both a right inner side and a left inner side of the holster, such that each strap is tightened around the tank.

16. The flotation device of claim 14, wherein the holster is an elongated cylindrical member.

17. The flotation device of claim 14, wherein the holster is made from a polyethylene mesh fabric.

18. The flotation device of claim 14, wherein the holster further comprises an insertion aperture for inserting the flotation piece into the cavity of the holster.

* * * * *